US006449812B1

(12) United States Patent
Calce

(10) Patent No.: US 6,449,812 B1
(45) Date of Patent: Sep. 17, 2002

(54) DEVICE FOR FIXING A BRACELET ON A WATCH CASE

(75) Inventor: Antonion Calce, Neuchatel (CH)

(73) Assignee: Cartier International B.V., Amsterdam (NL)

( * ) Notice: Subject to any disclaimer, the term of this patent is extended or adjusted under 35 U.S.C. 154(b) by 0 days.

(21) Appl. No.: 09/719,471

(22) PCT Filed: Apr. 19, 1999

(86) PCT No.: PCT/IB99/00692

§ 371 (c)(1),
(2), (4) Date: Dec. 13, 2000

(87) PCT Pub. No.: WO00/62638

PCT Pub. Date: Oct. 26, 2000

(51) Int. Cl.[7] ..... A44C 5/18
(52) U.S. Cl. ..... 24/265 WS; 24/68 J; 24/71 J; 224/164
(58) Field of Search ..... 24/265 WS, 68 J, 24/71 J; 224/164

(56) References Cited

U.S. PATENT DOCUMENTS

| | | | | | |
|---|---|---|---|---|---|
| 1,706,059 | A | * | 3/1929 | Hagel | 24/265 WS |
| 4,401,388 | A | * | 8/1983 | Mearns | 224/164 |
| 5,158,219 | A | * | 10/1992 | Baumgartner et al. | 224/164 |
| 6,168,055 | B1 | * | 1/2001 | Grados | 24/265 WS |

FOREIGN PATENT DOCUMENTS

| | | | | |
|---|---|---|---|---|
| CH | 0107902 | * | 11/1924 | 24/265 WS |
| CH | 350610 | | 1/1961 | |
| CH | 682875 | A3 | 12/1993 | |
| FR | 2490082 | | 3/1982 | |
| FR | 2703164 | A1 | 9/1994 | |

* cited by examiner

*Primary Examiner*—Victor Sakran
(74) *Attorney, Agent, or Firm*—Young & Thompson

(57) ABSTRACT

A device for fixing a bracelet on a watch case includes on at least one side of the watch case two blind perforations opening on the watch case peripheral wall and a globally U-shaped loop. The ends of the side branches of the U-shaped loop are designed to be engaged and fixed in an operative position in the blind perforations of the watch case.

7 Claims, 2 Drawing Sheets

A-A

A-A

DEVICE FOR FIXING A BRACELET ON A WATCH CASE

BACKGROUND OF THE INVENTION

Most wristwatches have watch casings provided with lugs for the securement of a watch strap with the help of resilient bars or not. The need to provide lugs on the watch casing is a constraint on the shape of the watch casing, which is often considered unacceptable by designers.

Different devices for securing the watch strap have been proposed in which all the device is integrated into the watch casing. Such devices are complicated and cumbersome because they require often complicated machining of the watch case.

SUMMARY OF THE INVENTION

The present invention has for its object the provision of a device for securement of a watch strap on a watch casing, which overcomes the above drawbacks and which moreover will be simple, not cumbersome and particularly sturdy to be adapted for sport or dive watches. Another object of the present invention is to facilitate the mounting of a watch strap on a watch casing, whether this watch strap is flexible or rigid.

The accompanying drawings show schematically and by way of example two embodiments of the device for securing a watch strap on a watch casing according to the invention.

DETAILED DESCRIPTION OF THE PREFERRED EMBODIMENT

Figure 1:
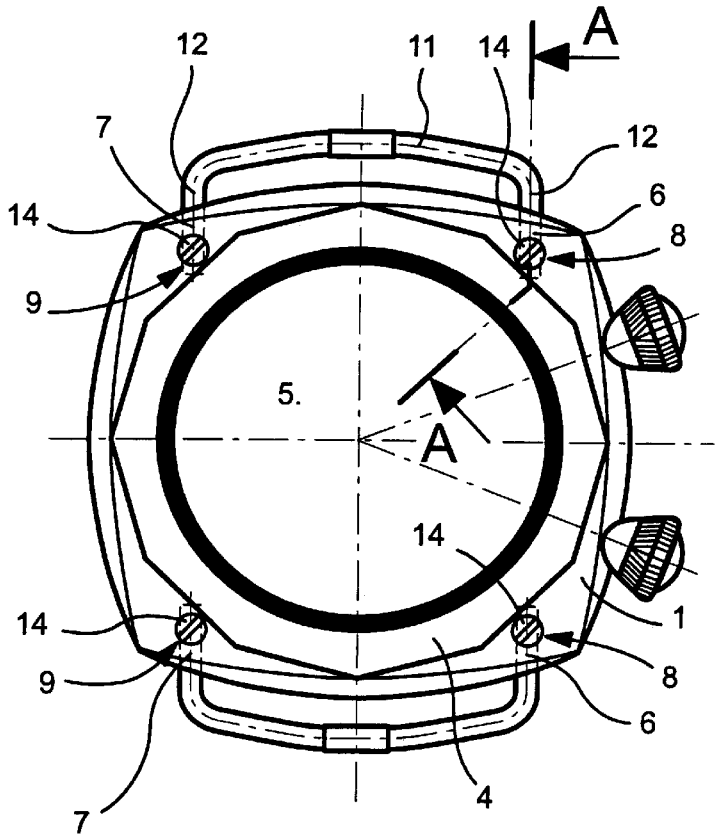
FIG. 1 is a bottom plan view of a watch casing provided with the device according to the invention.
Figure 3:
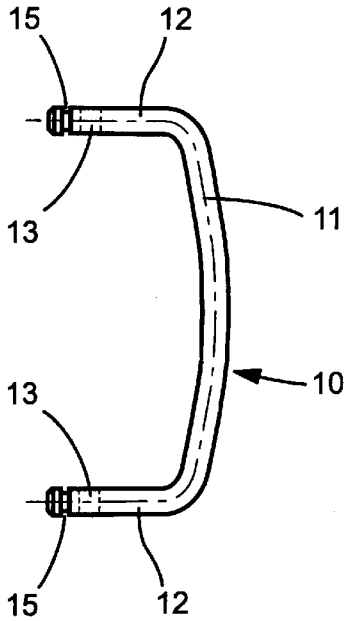
FIG. 3 shows in plan a first embodiment of wire loop forming part of the device.

The illustrated watch casing of the watch strap securement device according to the invention comprises a casing 1, a bezel 2 in which is fixed a crystal 3 and a bottom 4 also comprising a crystal 5. Of course, the casing 1 could comprise an all-metal bottom in other embodiments.

The device for securing the watch strap on this watch casing comprises on the two sides of the casing 1, here at 12H and at 6H, two blind holes 6, 7 provided in the watch casing and opening on the peripheral surface. These holes 6, 7 are parallel to each other and located in planes parallel to the plane of symmetry of the watch casing 12H-6H located at an equal distance from this plane of symmetry.

In the illustrated example, the axis of the blind holes 6, 7 is inclined relative to the upper and lower surfaces of the casing 1, the angle of inclination of these holes can vary as desired between about +60° and −60°.

The watch casing is also provided with screwthreaded holes 8, 9 opening on the lower surface of the casing 1 and whose axes intersect the blind holes 6, 7.

In a first embodiment, the securement device of a watch strap on a watch case also comprises securement members for the watch strap constituted by generally U-shaped bent wires or rods 10. These members or loops 10 each comprise an intermediate portion 11 adapted to receive the watch strap (not shown) and two ends 12 bent at about 90°. Each of these ends or branches 12 comprises on its lower surface, adjacent its end, a recess 13. Between this recess 13 and the end of the leg 12, the latter comprises a throat 15 receiving O-ring joint to guarantee stability of the assembly against vibrations.

The intermediate portion 11 of these loops 10 receives the watch strap, the latter can be bent about this intermediate portion or can comprise at its end a passage receiving this intermediate portion 11.

Once the watch strap is threaded or fixed on this intermediate portion of the loop 10, the ends of the legs 12 of the latter are each slipped into one of the blind holes 6, 7 to a position in which the recess 13 is located in prolongation of the tapped holes 8, 9.

To complete the assembly, screws 14 are screwed into the tapped holes 8, 9 of the casing 1, and their ends enter into the recesses 13 and the legs 12 of the attachment members 10 and fix the latter firmly in place on the casing 1. The screws 14 are provided with O-ring joints 14*a,* to avoid their unscrewing under the influence of vibrations.

This securement device is very simple and very sturdy. Moreover, it requires only simple machining of the casing and can be incorporated into any kind of watch casing, no matter what its shape.

In the different modifications illustrated, the loop 10 comprises at the end of its legs 12 circular grooves 15 adapted to receive an anti-vibration joint 16.

Figure 4:
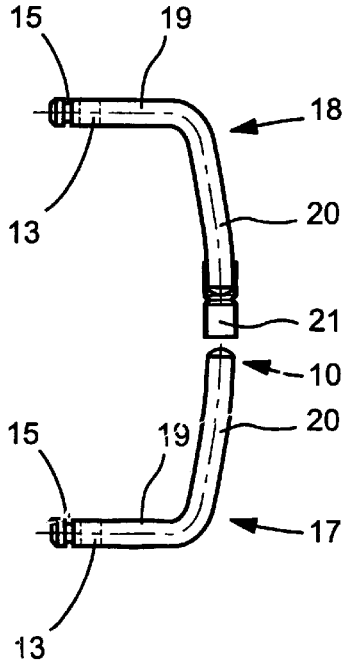
FIG. 4 shows in plan a second embodiment of a wire loop forming,a part of the device.
Figure 2:
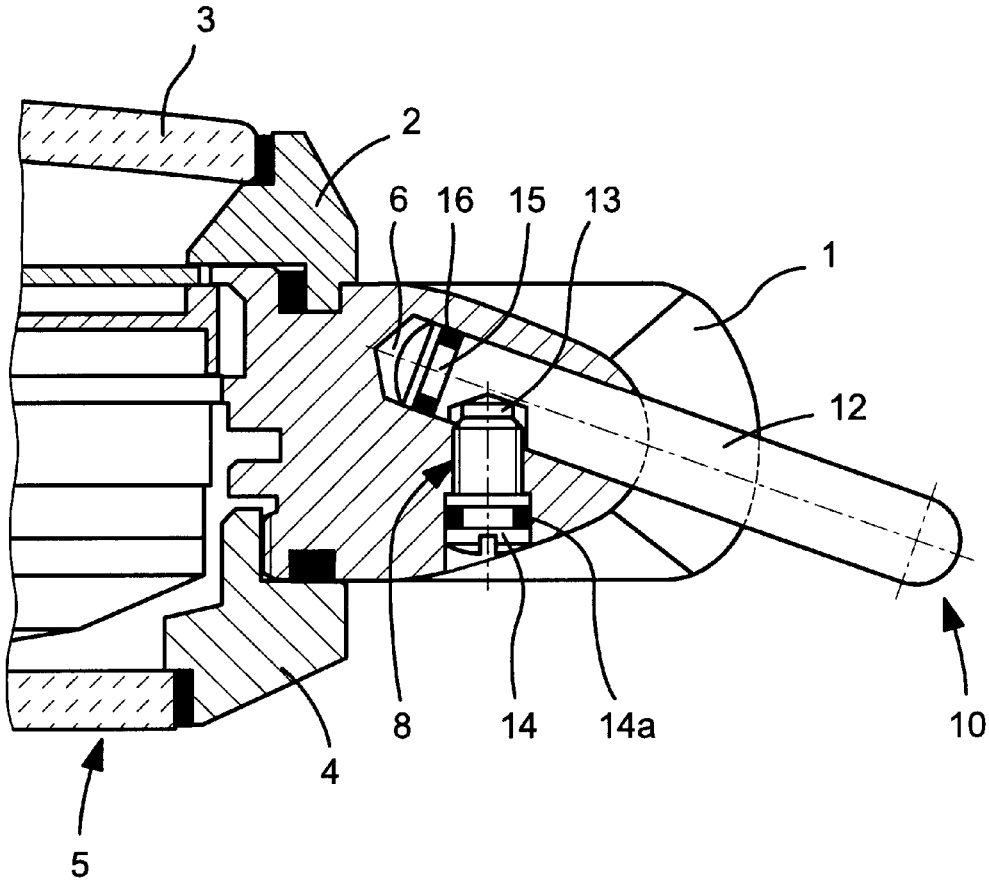
FIG. 2 is a fragmentary cross-section, on an enlarged scale, on the line A—A of FIG. 1.

In the second embodiment shown in FIG. 4, the securement member of the watch strap or loop 10 is constituted by two elbowed rods or wires 17, 18 of L shape. The short legs 19 of these rods 17, 18 comprise as in the first embodiment a recess 13 and a groove 15. A tube 21 permits interconnecting the free ends of the long legs 20 of these rods 17, 18 to create a complete securement member for the watch strap. Thanks to this embodiment in two parts of the loop 10, first one part 17 can be fixed on the watch casing, then the portion of the watch strap comprising a passage can be slipped over the leg 20 provided with the tube 21 fixed to the casing. Then the leg 20 of the other portion 18 is slipped into the passage of the watch strap adapted to receive it. This portion 18 is introduced in such a way that the end of the leg 20 will be inserted into the free end of the tube 21, then the free end of the leg 19 is fixed to the watch casing.

The tube 21 has a constriction in the middle of its length to ensure that it surrounds completely the ends of the two legs 20 in the service position and that it cannot slide too deeply on one of the legs 20.

Each loop 10 can be formed from a wire or rod of stainless steel bent and machined to a diameter of 1 to 2 mm for example. It will be seen accordingly that the attachment of the watch strap to the watch is very secure. The mechanical securement is simple and sturdy. It is moreover easily disassembleable.

What is claimed is:

1. A device for securing a watch strap on a watch casing comprising:

two blind parallel holes opening on a peripheral wall of the casing; and a loop of general U-shape having lateral legs with ends adapted to be engaged and fixed in a service position in said blind holes of the watch casing, said blind holes and said loop being on at least one side of the watch casing, wherein each blind hole of the watch casing includes a passage connecting said blind hole to a lower surface of the watch casing, said passage being at least partially screwthreaded, screws coacting with the screw threadings block, in the service position, the legs of the loop in the corresponding hole.

2. The device according to claim 1, comprising two pairs of blind holes on two opposite sides of the watch casing, each pair of holes serving to secure one loop.

3. The device according to claim 1, wherein the blind holes of the watch casing are disposed in a plane parallel to a plane of the watch casing.

4. The device according to claim 1, wherein the blind holes of the watch casing are disposed in planes forming an angle with a plane of the watch casing.

5. The device according to claim 1, wherein each leg of the loop comprises a recess opening on a lower surface, an end of a blocking screw being disposed in each recess.

6. The device according to claim 1, wherein each loop comprises two elbowed L-shaped portions having first and second leg parts, each first leg part is adapted to be placed, in the service position, in one of the holes of a pair of blind holes of the casing and each second leg part is adapted to be interconnected by a tubular sleeve.

7. A device for securing a watch strap on a watch casing comprising:

two blind parallel holes opening on a peripheral wall of the casing; and a loop of general U-shape having lateral legs with ends adapted to be engaged and fixed in a service position in said blind holes of the watch casing, said blind holes and said loop being on at least one side of the watch casing, wherein each loop comprises two elbowed L-shaped portions having first and second leg parts, each first leg part is adapted to be placed, in the service position, in one of the holes of a pair of blind holes of the casing and each second leg part is adapted to be interconnected by a tubular sleeve.

* * * * *